US008235639B2

(12) United States Patent
Hug et al.

(10) Patent No.: US 8,235,639 B2
(45) Date of Patent: Aug. 7, 2012

(54) METHOD FOR PRODUCING ADHESIVE-BOUND BOOK BLOCKS FROM GATHERED SIGNATURES

(75) Inventors: Theo Hug, Wallenwil (CH); Peter Fischer, Winterthur (CH); Heinz Bötchi, Mauren (CH)

(73) Assignee: Mueller Martini Holding AG, Hergiswil (CH)

( * ) Notice: Subject to any disclaimer, the term of this patent is extended or adjusted under 35 U.S.C. 154(b) by 893 days.

(21) Appl. No.: 12/196,685

(22) Filed: Aug. 22, 2008

(65) Prior Publication Data

US 2009/0060683 A1 Mar. 5, 2009

(30) Foreign Application Priority Data

Aug. 27, 2007 (EP) ..... 07405252

(51) Int. Cl.

| | |
|---|---|
| ***B42C 11/00*** | (2006.01) |
| ***B42C 13/00*** | (2006.01) |
| ***B42C 11/02*** | (2006.01) |
| ***B42C 11/04*** | (2006.01) |
| ***B42B 9/00*** | (2006.01) |

(52) U.S. Cl. ..... 412/21; 412/4; 412/5; 412/13; 412/19; 412/20

(58) Field of Classification Search ..... 412/4–5, 412/11, 13, 19–21; 270/52.16
See application file for complete search history.

(56) References Cited

U.S. PATENT DOCUMENTS

| | | | | | |
|---|---|---|---|---|---|
| 1,248,252 | A * | 11/1917 | Bredenberg | ..... | 412/19 |
| 1,252,879 | A * | 1/1918 | Bredenberg | ..... | 412/19 |
| 3,093,396 | A * | 6/1963 | Segreto | ..... | 412/16 |
| 3,132,360 | A * | 5/1964 | Hawkes et al. | ..... | 412/30 |
| 3,179,967 | A * | 4/1965 | Yohn et al. | ..... | 412/16 |
| 4,014,732 | A * | 3/1977 | Beckert et al. | ..... | 412/30 |
| 4,507,036 | A * | 3/1985 | Rathert | ..... | 412/9 |
| 4,524,857 | A * | 6/1985 | Rathert et al. | ..... | 412/16 |
| 2006/0177286 | A1 * | 8/2006 | Rygol | ..... | 412/21 |
| 2009/0155022 | A1 * | 6/2009 | Garlichs et al. | ..... | 412/21 |

FOREIGN PATENT DOCUMENTS

| | | |
|---|---|---|
| CH | 504 977 | 3/1974 |
| DE | 28 15 144 A1 | 10/1978 |
| DE | 30 19 101 A1 | 2/1981 |
| DE | 100 01 946 A1 | 7/2001 |

(Continued)

OTHER PUBLICATIONS

Kipphan, H. "Handbook of Print Media Technologies and Production Methods" p. 833-834, XP-002462107.
European Search Report for EP 07 04 5252.3 dated Jan. 2, 2008.

*Primary Examiner* — Edward Tolan
*Assistant Examiner* — Kyle Grabowski
(74) *Attorney, Agent, or Firm* — Venable LLP; Robert Kinberg; Ryan M. Flandro

(57) ABSTRACT

A method for producing adhesive-bound book blocks from gathered signatures for which the individual signatures forming a non-bound book block are supplied while positioned on the spine on a transfer section to an opened conveying clamp on a perfect binder and are subsequently held while clamped in by the closed conveying clamp along the flat outer surfaces. The gathered signatures of a book block are released in an additional conveying section from the conveying clamp in order to be aligned while guided. Prior to leaving the conveying section for aligning the signatures, the signatures are clamped in once more by the conveying clamps along the flat outer surfaces, so that they can be conveyed to further processing locations.

12 Claims, 3 Drawing Sheets

FOREIGN PATENT DOCUMENTS

| | | | |
|---|---|---|---|
| DE | 102 21 542 | A1 | 11/2003 |
| EP | 0 453 743 | A1 | 10/1991 |
| EP | 1 155 874 | A2 | 11/2001 |
| EP | 1 407 895 | A1 | 4/2004 |
| EP | 1 726 552 | A1 | 11/2006 |
| EP | 1 886 832 | A1 | 2/2008 |

* cited by examiner

METHOD FOR PRODUCING ADHESIVE-BOUND BOOK BLOCKS FROM GATHERED SIGNATURES

CROSS-REFERENCE TO RELATED APPLICATION

This application claims the priority of European Patent Application No. 07405252.3, filed on Aug. 27, 2007, the subject matter of which is incorporated herein by reference in its entirety.

BACKGROUND OF THE INVENTION

The invention relates to a method for producing adhesive-bound book blocks composed of gathered signatures. With this method, the individual signatures forming a non-bound book block are supplied to an opened conveying clamp for an adhesive binder while positioned on their spines in a transfer section and are subsequently held in place by the closed conveying clamp along the flat outer surfaces. The invention furthermore relates to an apparatus for realizing the method.

For an industrial-type production of adhesive-bound printed products, for example magazines, catalogs, paperback books or similar products, printed sheets or signatures are gathered during a first step to form non-bound book blocks. Subsequently, the spinal region of these book blocks is processed, for example by milling, and is then provided with adhesive in a perfect binder, whereupon the book blocks are bound and/or provided with a casing. The position of the printed image on the sheet or the signature is determined in reference to the edges of its spine and generally also in reference to the top edges. Thus, if all signatures of a non-bound book block are aligned with these reference edges, then all pages within a book block are also aligned relative to each other. According to known prior art, signatures positioned inside a conveying channel are gathered and aligned with the aid of circulating conveying elements. A gathering device of this type is disclosed, for example, in European patent document EP 1 726 552 A1. Following the gathering of the signatures, the non-bound book blocks having spine edges that are aligned transverse to the conveying direction are then rotated by 90°, so that the spinal edges are aligned parallel with the conveying direction. In a further step, the non-bound book blocks are positioned upright on the spines, so that their flat sides are perpendicular and, in this position, are inserted from below into the conveying clamps of the perfect binder. A method of this type is disclosed in the applicant's own, European Patent No: EP 1886832. During the complete binding process, the book blocks are clamped into the circulating conveying clamps, wherein their flat sides are positioned perpendicular and parallel to the conveying direction and the spine areas project slightly from the conveying clamps, in a downward direction. The positioning accuracy for the book blocks in the conveying clamps is decisive for the quality of a book.

SUMMARY OF THE INVENTION

It is therefore an object of the present invention to be able to supply precisely aligned book blocks composed of loosely gathered signatures to the conveying clamps of a perfect binder.

The above and other objects are accomplished according to the invention by the provision of a method for producing an adhesive-bound book block from gathered signatures, which according to one embodiment includes: supplying a non-bound book block composed of gathered signatures which are respectively positioned on their spines to an opened conveying clamp in a first conveying section of a perfect binder; subsequently closing the conveying clamp and holding the non-bound book block by the closed conveying clamp along the flat outer surfaces of the non-bound book block; releasing the gathered signatures from the conveying clamp in a second conveying section and aligning and guiding the gathered signatures of the non-bound book block; and after the gathered signatures are aligned and guided during the releasing step, and prior to leaving the second conveying section, clamping the signatures in again along the flat outer surfaces by closing the conveying clamp so that the signatures can be transported to a further processing location.

Thus, according to the invention, the signatures gathered to form a book block are aligned in an additional conveying section while no longer clamped in by the conveying clamp but guided by it, and by closing the conveying clamp again prior to leaving the conveying section that is designed for aligning the signatures, such that the signatures are clamped in along the flat outer surface areas for a transport to further processing locations.

BRIEF DESCRIPTION OF THE DRAWINGS

These and other features and advantages of the invention will be further understood from the following detailed description with reference to the accompanying drawings, which show in.

DETAILED DESCRIPTION

Figure 1:
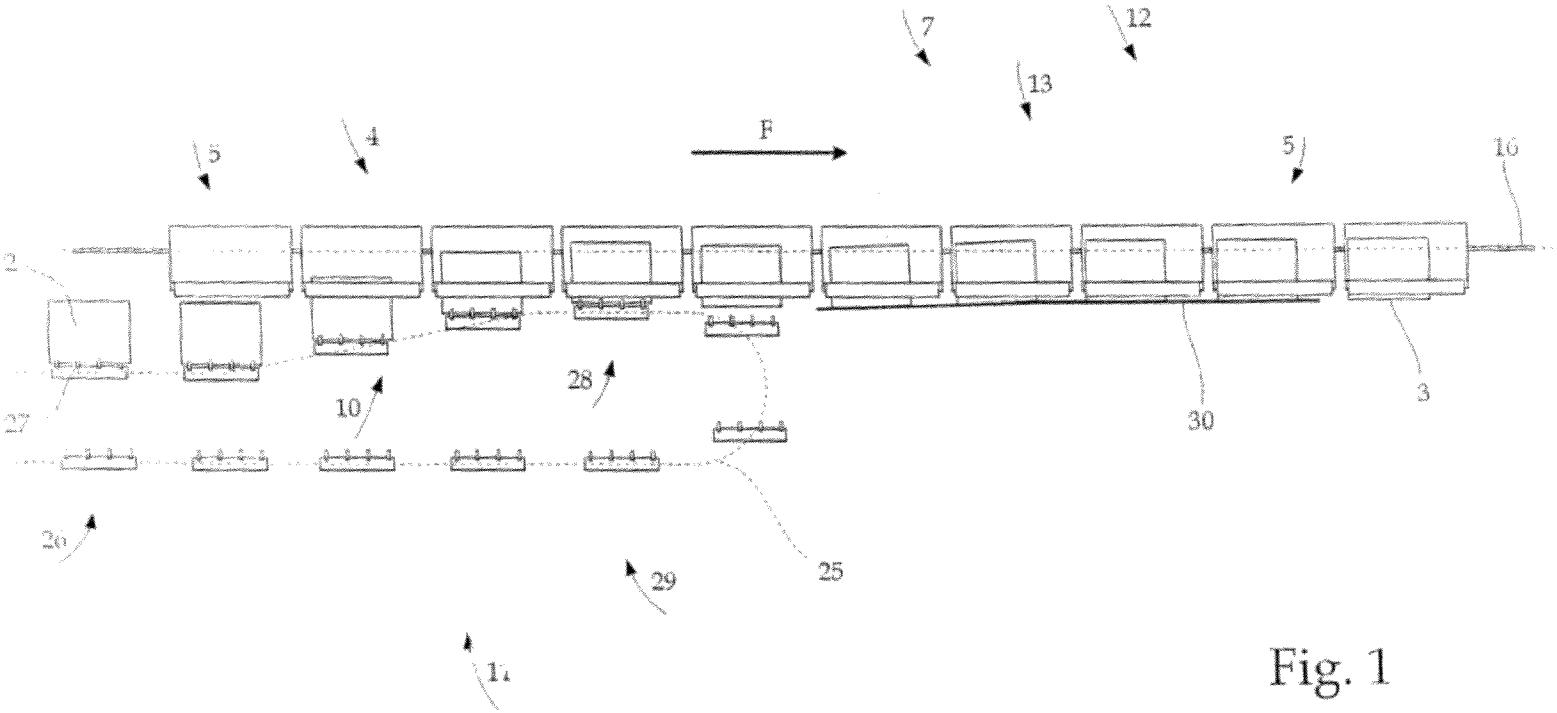
FIG. 1 A simplified representation showing a transfer section for a perfect binder, with a following processing section.
Figure 2:
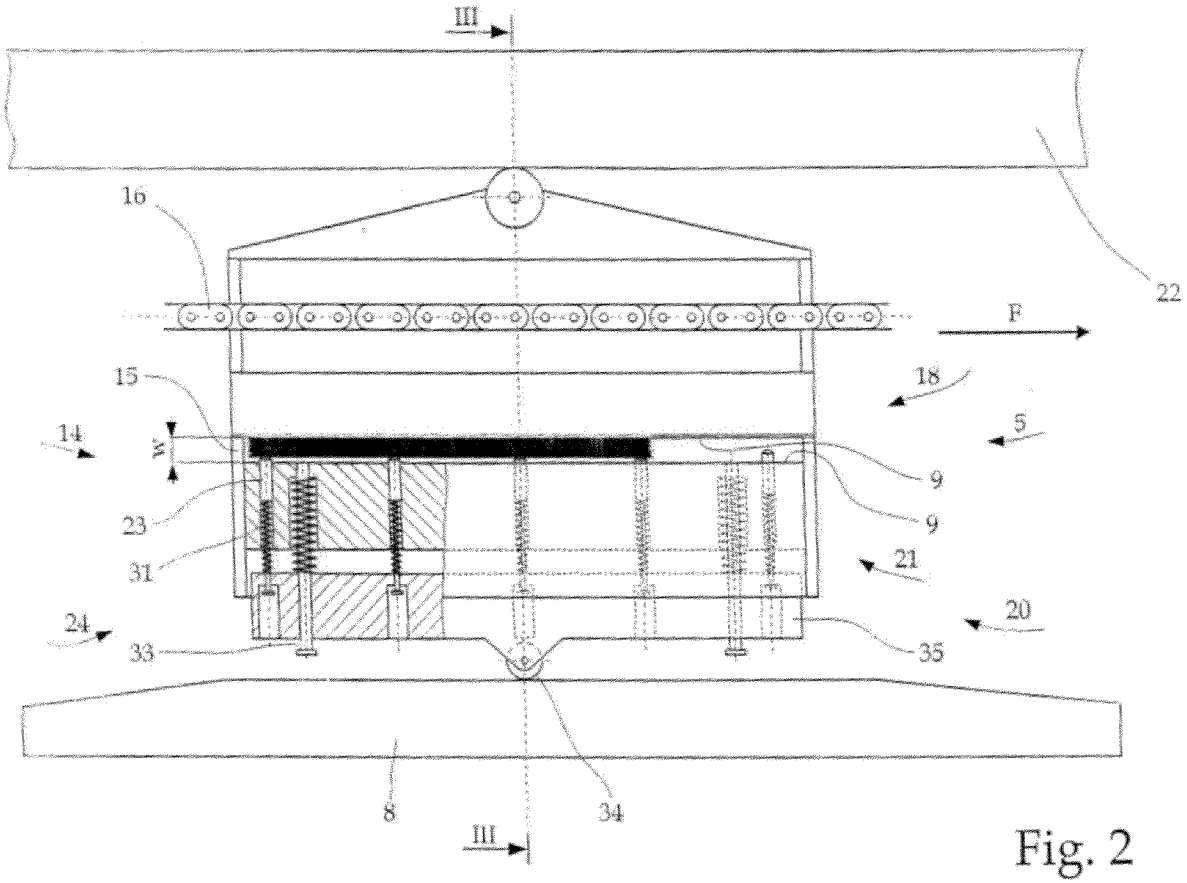
FIG. 2 A view from above, showing a conveying clamp with a partially clamped-in book block.
Figure 3:
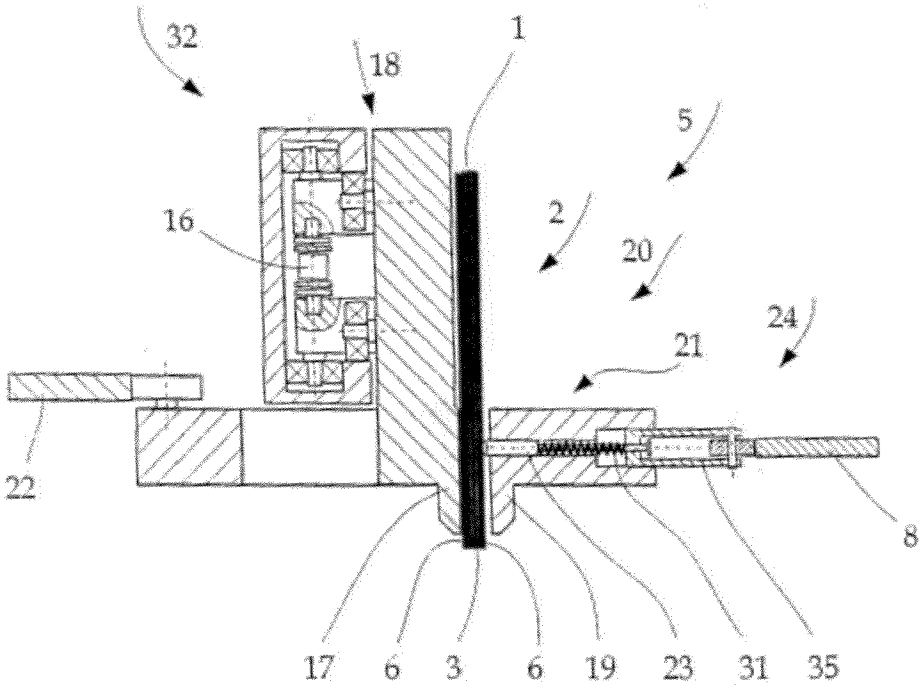
FIG. 3 A view of a section through the conveying clamp, along the line III-III in FIG. 2.

FIG. 1 shows a transfer section 4 and a processing section 12 that follows the transfer section 4 on a perfect binder, which is provided with uniformly spaced-apart conveying clamps 5 that are attached to a circulating traction device 16 for conveying the book blocks 2 composed of loosely gathered signatures 1. Each conveying clamp 5 comprises a first clamp part 18 and a second clamp part 20. The first clamp part 18 is fixedly connected to the traction device 16 and forms a first clamping jaw 17. The second clamp part 20 forms a second clamping jaw 19 that is movably attached to the first clamp part 18 and is guided transverse to the conveying direction F, for the opening and closing of the conveying clamp 5, wherein the non-bound book blocks 2 can be clamped in between the two clamp parts 18 and 20. Each conveying clamp 5 has a back end 14, relative to the conveying direction F, on which there is provided a pusher 15 that is assigned to the book block 2 (see also FIGS. 2 and 3). The first clamp part 18 is moved by rollers inside a guide 32 in the conveying direction F and is driven by the traction device 16. With the aid of a closing spring that is not shown herein, for example as disclosed in the Swiss patent document CH 504 977, the second clamp part 20 can be clamped against the first clamp part 18 with the clamping force necessary for the processing. The movable second clamp part 20 furthermore is provided with a holding device 21, which projects over the clamping surface 9 of the second clamping jaw 19 and partially acts upon a flat outer surface 6 of a book block 2 and can be pulled back from the clamping surface 9. The holding device is formed with the aid of several holding elements 23, which are movable perpendicularly to the clamping surface 9 and are jointly assigned to and can be operated by a pull-back device 24. The pull-back device 24 essentially consists of a rod 35 that is guided along the second clamp part 20 inside longitudinal guides 33 and is spring supported counter to the second clamp part 20, wherein this rod can be displaced with the aid of a roller 34 and a guide rail 8 in the direction transverse to the conveying direction F. In order to generate a holding force that is necessary for conveying the book blocks 2 held in the conveying clamps 5, a spring force generated by the springs 31 supports the individual holding elements 23.

By dividing the holding force, which is lower than the clamping force, over several partial areas of the outer surfaces of a book block to ensure a secure transport of the book block 2 from the transfer section 4 to the conveying section 7 and/or the aligning section 13, the signatures 1 are prevented from adhering to each other and the outermost signatures 1 are prevented from adhering to the clamping jaws 17, 19. The conveying clamps 5 are opened and closed with the aid of an opening rail 22, which allows the second clamp part 20 to move counter to the force of the closing spring and which keeps the conveying clamp 5 open by maintaining the necessary opening width W for aligning the signatures 1 of a book block 2. With the aid of a conveying device 11, the non-bound book blocks 2 of gathered signatures 1, which are respectively positioned upright on their spines, are inserted from below into the opened conveying clamps 5 of the perfect binder in a transfer region 10, formed by the conveying device 11 and the transfer section 4. In the region of the transfer section 4, the opening width W is selected such that the non-bound signatures 1 forming the book blocks 2 can be inserted without problem between the clamping jaws 17, 19. For this operation, the holding elements 23 are moved back to the inactive outer end position with the aid of the pullback device 24. The conveying device 11 essentially comprises a plurality of conveying elements 26, provided with grippers 27, which are driven to circulate along a path 25. During the transfer from the conveying device 11 to the opened conveying clamps 5 of the perfect binder, the book blocks are clamped in and/or held along the flat sides 6 by the grippers 27 and are positioned on their spines for being guided on the side by the clamping jaws 17, 19. The conveying elements 26 remain essentially aligned horizontally for this, as shown in FIG. 1. The horizontal component of the conveying speed for the conveying elements 26 with the book blocks 2 approximately corresponds to the conveying speed of the conveying clamps 5 in the conveying direction F. As soon as the conveying elements 26 reach an upper, straight section 28 of the path 25, which is parallel to the conveying direction F, the book blocks 2 are gripped and/or held in the conveying clamps 5 with a holding force that is partially distributed over their flat outer surfaces 6, between the movable holders 23 and the first clamping jaw 17. The grippers 27 of the conveying elements 26 are opened and redirected to a return movement section 29 of the path 25. For this, the pullback device 24 is pressed with the aid of the control rail 8 against the conveying clamp 5 and the holding elements 23 are released, so that they can press the signatures with the force of the springs 31 against the first clamping jaw 17 of the first clamp part 18. The book blocks 2, which are transferred in this way in the transfer section 4 to the conveying clamps 5, are subsequently supplied to the conveying section 7 that is embodied as an alignment or straightening table 30 with a section 13 for aligning the signatures 1 while the conveying clamps 5 are sufficiently opened up. In the conveying section 7, the holding elements 23 together with the pull-back device 24 are moved back again to the inactive outer end position. The non-bound book blocks 2 are then guided while positioned between the first clamping jaw 17 and the second clamping jaw 19 that move along the flat outer surfaces 6 and by the alignment table 30 from below along the spine 3. The further transport of the book blocks 2 in the conveying direction F respectively occurs with the aid of the pushers 15, arranged at the back end 14 of the conveying clamps 5, wherein the signatures 1 are simultaneously aligned uniformly along one edge against the pushers 15. In order to support this alignment, the alignment table 30 can be operated oscillating or can be admitted with vibrations. At the downstream end of the alignment table 30, respectively before leaving the conveying section 7 and/or the alignment section 13 for aligning the signatures 1, the conveying clamps 5 are closed and the book blocks 2 are clamped in between the clamping surfaces 9 of the clamping jaws 17, 19, wherein the clamping force required for the transport to a further processing location is applied against the flat outer surfaces 6. The holding force applied by the conveying clamps 5 to the book blocks 2 during the transfer from the transfer section 4 to the conveying section 7 is considerably lower than the clamping force that is necessary for the processing.

It will be understood that the above description of the present invention is susceptible to various modifications, changes and adaptations, and that the same are intended to be comprehended within the meaning and range of equivalents of the appended claims.

What is claimed is:

1. A method for producing an adhesive-bound book block from gathered signatures, each signature having a spine, the method comprising:

supplying a non-bound book block composed of gathered signatures which are respectively positioned on their spines to an opened conveying clamp in a first conveying section of a perfect binder, the non-bound book block having flat outer surfaces;

subsequently closing the conveying clamp and holding the non-bound book block by the closed conveying clamp along the flat outer surfaces of the non-bound book block;

releasing the non-bound book block from the conveying clamp in a second conveying section and aligning and guiding the gathered signatures of the non-bound book block in the second conveying section; and after the gathered signatures of the non-bound book block are aligned and guided during the releasing step, and prior to leaving the second conveying section, clamping the non-bound book block along the flat outer surfaces by closing the conveying clamp so that the non-bound book block can be transported to a further processing location, wherein prior to the releasing step, the non-bound book block is held by holding elements with a holding force distributed over a partial area of the flat outer surface of the non-bound book block, wherein the clamping step includes clamping the non-bound book block on the flat outer surfaces with a clamping force necessary for further processing, and wherein the holding force applied to the flat outer surfaces during the closing and holding step is lower than the clamping force applied in the clamping step.

2. An apparatus for producing a bound book block from gathered signatures in a perfect binder having a transfer section, the apparatus comprising:

a conveying device that forms a transfer region together with the transfer section of the perfect binder;

a circulating traction device including uniformly spaced apart conveying clamps arranged and configured to receive respective non-bound book blocks composed of gathered signatures from the conveying device in the transfer region and to supply the non-bound book blocks to a processing section that follows the transfer section on the perfect binder, each conveying clamp having a back end, as seen in a conveying direction, and including:

a pusher arranged at the back end of the conveying clamp;

a first clamping part fixedly connected to the traction device to form a first clamping jaw;

a second clamping part moveably arranged on the first clamping part to form a second clamping jaw for movement transverse to the conveying direction to open and close the conveying clamp, wherein the second clamping part includes a holding device having a plurality of holding elements moveable relative to a clamping surface of the second clamping jaw, each holding element biased toward the first clamping part to press upon a partial area of a flat outer surface of the non-bound book block with a holding force, wherein the holding device is pullable back from the clamping surface;

first and second separate activation devices operatively arranged, respectively with the second clamping jaw and the holding device, wherein the plurality of holding elements are movable perpendicular to the clamping surface and arranged to be jointly activated by the second activation device; and springs arranged to respectively support each of the holding elements and generate the holding force.

3. The apparatus according to claim 2, wherein the holding device comprises a pull back device, and wherein each of the holding elements are coupled to the pull back device.

4. The apparatus according to claim 2, wherein the first and second clamping jaws are biased toward one another.

5. The apparatus according to claim 4, further comprising an opening rail arranged to be engaged by a guide roller of the second clamping part to open the conveying clamp.

6. An apparatus for producing a bound book block from gathered signatures in a perfect binder having a transfer section, the apparatus comprising:

a conveying device that forms a transfer region together with the transfer section of the perfect binder;

a circulating traction device including uniformly spaced apart conveying clamps arranged and configured to receive respective non-bound book blocks composed of gathered signatures from the conveying device in the transfer region and to supply the non-bound book blocks to a processing section that follows the transfer section on the perfect binder, each conveying clamp having a back end, as seen in a conveying direction, and including:

a pusher arranged at the back end of the conveying clamp;

a first clamping part fixedly connected to the traction device to form a first clamping jaw;

a second clamping part moveably arranged on the first clamping part to form a second clamping jaw for movement transverse to the conveying direction to open and close the conveying clamp, wherein the second clamping part includes a holding device having a plurality of holding elements moveable relative to a clamping surface of the second clamping jaw, each holding element biased toward the first clamping part to press upon a partial area of a flat outer surface of the non-bound book block with a holding force, and wherein the holding device includes a pull-back device comprising:

a rod moveably arranged relative to the second clamping jaw along longitudinal guides, wherein the rod is biased away from the second clamping jaw, and wherein each of the holding elements are moveably attached to the rod; and a guide roller coupled to the rod and arranged to engage a guide rail.

7. The apparatus according to claim 6, wherein each holding element is biased away from the rod and extends through the second clamping jaw, whereby when the guide roller engages the guide rail, the rod is moved toward the second clamping jaw and the holding elements press the non-bound book block with the holding force, and whereby when the guide roller is not engaged with the guide rail, the rod is biased away from the second clamping jaw and the holding elements are pulled back away from the non-bound book block.

8. The apparatus according to claim 7, wherein the rod is biased away from the second clamping jaw by a first spring, and wherein each holding element is biased away from the rod and toward the second clamping jaw by a respective second spring.

9. A method for producing an adhesive-bound book block from gathered signatures, each signature having a spine, the method comprising:

supplying a non-bound book block composed of gathered signatures which are respectively positioned on their spines to an opened conveying clamp in a first conveying section of a perfect binder, the non-bound book block having flat outer surfaces;

subsequently closing the conveying clamp and holding the non-bound book block by the closed conveying clamp along the flat outer surfaces of the non-bound book block;

releasing the non-bound book block from the conveying clamp in a second conveying section and aligning and guiding the gathered signatures of the non-bound book block in the second conveying section; and after the gathered signatures of the non-bound book block are aligned and guided during the releasing step, and prior to leaving the second conveying section, clamping the non-bound book block along the flat outer surfaces by closing the conveying clamp so that the non-bound book block can be transported to a further processing location, wherein the conveying clamp comprises first and second clamping parts, the second clamping part moveable relative to the first clamping part and including a holding device having a plurality of holding elements movable relative to a clamping surface of the second clamping part, and wherein the closing and holding step comprises:

activating the holding device, whereby the holding elements extend from the clamping surface of the second clamping part toward the first clamping part and press several partial areas of the flat outer surface of the non-bound book block.

10. The method of claim 9, wherein a pull-back device is coupled to each of the holding elements, and wherein the step of activating the holding device comprises moving the pull-back device toward the second clamping part to allow the holding elements to extend from the clamping surface of the second clamping part.

11. The method of claim 10, wherein the releasing step comprises moving the pull-back device away from the second clamping part and retracting the holding elements.

12. The method of claim 9, wherein the clamping step comprises:

moving the clamping surface of the second clamping part toward the first clamping part to close the conveying clamp.

* * * * *